US006752312B1

(12) United States Patent
Chamberlain et al.

(10) Patent No.: US 6,752,312 B1
(45) Date of Patent: Jun. 22, 2004

(54) GAMING MACHINE WITH HOPPER AND PRINTER

(75) Inventors: John W. Chamberlain, Carson City, NV (US); Joseph R. Hedrick, Reno, NV (US); Ali Saffari, Reno, NV (US); Larry R. Hollibaugh, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/659,924

(22) Filed: Sep. 12, 2000

(51) Int. Cl.[7] ..... G06F 17/00
(52) U.S. Cl. ..... 235/375; 235/379
(58) Field of Search ..... 273/138.1; 463/16–21; 235/375, 379, 380, 381, 382; 700/213, 231, 232

(56) References Cited

U.S. PATENT DOCUMENTS

| | | | | |
|---|---|---|---|---|
| 3,560,715 | A | 2/1971 | Osaka | 235/61.8 |
| 4,475,564 | A | 10/1984 | Koester et al. | 133/8 R |
| 4,518,001 | A | 5/1985 | Branham | 133/5 R |
| 4,574,824 | A | 3/1986 | Paulsen et al. | 133/4 R |
| 4,650,978 | A | 3/1987 | Hudson et al. | 235/380 |
| 4,978,322 | A | 12/1990 | Paulsen | 453/57 |
| 5,007,641 | A | 4/1991 | Seidman | 273/138 A |
| 5,038,022 | A | 8/1991 | Lucero | 235/380 |
| 5,113,990 | A | 5/1992 | Gabrius et al. | 194/206 |
| 5,167,571 | A | 12/1992 | Waller | 453/29 |
| 5,265,874 | A | 11/1993 | Dickinson et al. | 273/138 A |
| 5,290,033 | A | 3/1994 | Bittner et al. | 273/138 A |
| 5,326,104 | A | 7/1994 | Pease et al. | 273/138 A |
| 5,371,345 | A | 12/1994 | LeStrange et al. | 235/380 |
| 5,409,092 | A | 4/1995 | Itako et al. | 194/210 |
| 5,440,108 | A | 8/1995 | Tran et al. | 235/381 |
| 5,457,306 | A | 10/1995 | Lucero | 235/380 |
| 5,470,079 | A | 11/1995 | LeStrange et al. | 273/138 A |
| 5,491,326 | A | 2/1996 | Marceau et al. | 235/381 |
| 5,559,312 | A | 9/1996 | Lucero | 235/380 |
| 5,595,538 | A | 1/1997 | Haste, III | 463/17 |
| 5,609,337 | A | 3/1997 | Clapper, Jr. | 273/138.2 |
| 5,624,316 | A | 4/1997 | Roskowski et al. | 463/45 |
| 5,627,356 | A | 5/1997 | Takemoto et al. | 235/381 |
| 5,628,684 | A | 5/1997 | Bouedec | 463/17 |
| 5,645,485 | A | 7/1997 | Clapper, Jr. | 463/17 |
| 5,650,761 | A | 7/1997 | Gomm et al. | 235/381 |
| 5,655,966 | A | 8/1997 | Werdin, Jr. et al. | 463/25 |
| 5,674,128 | A | 10/1997 | Holch et al. | 463/42 |
| 5,676,231 | A | 10/1997 | Legras et al. | 194/206 |
| 5,749,784 | A | 5/1998 | Clapper, Jr. | 463/17 |
| 5,753,899 | A | 5/1998 | Gomm et al. | 235/381 |
| 5,800,269 | A | 9/1998 | Holch et al. | 463/42 |
| 5,811,772 | A | 9/1998 | Lucero | 235/380 |
| 5,813,510 | A * | 9/1998 | Rademacher | 194/206 |
| 5,816,918 | A | 10/1998 | Kelly et al. | 463/16 |
| 5,902,983 | A * | 5/1999 | Crevelt et al. | 235/375 |
| 5,919,091 | A | 7/1999 | Bell et al. | 463/25 |
| 5,928,082 | A | 7/1999 | Clapper, Jr. | 463/16 |
| 5,949,042 | A | 9/1999 | Dietz, II et al. | 235/375 |
| 5,952,640 | A | 9/1999 | Lucero | 235/380 |
| 5,959,277 | A | 9/1999 | Lucero | 235/380 |

(List continued on next page.)

*Primary Examiner*—Michael G. Lee
*Assistant Examiner*—Jamara A. Franklin
(74) *Attorney, Agent, or Firm*—Marshall, Gerstein & Borun LLP

(57) ABSTRACT

A gaming machine in which the form of pay out is selectable by the operator and/or user to provide a pay out with coins or by way of a ticket. The gaming machine incorporates both a hopper for coin operated play as well as a printer for cashless play. In accordance with one aspect of the machine, the system can automatically detect when one of the pay out systems is disabled or otherwise unavailable and automatically continue operation with the other pay out method to allow the machine to function in a limited state. The system thus helps the transition for players from coin operated machines to cashless gaming machines, and accommodates users with different cash out preferences. The gaming machine also accepts tickets, allowing users to easily move their credits from one gaming machine to another.

11 Claims, 7 Drawing Sheets

U.S. PATENT DOCUMENTS

| | | | | | |
|---|---|---|---|---|---|
| 5,980,384 | A | * | 11/1999 | Barrie | 273/138.1 |
| 6,003,651 | A | | 12/1999 | Waller et al. | 194/202 |
| 6,007,426 | A | | 12/1999 | Kelly et al. | 463/16 |
| 6,012,832 | A | | 1/2000 | Saunders et al. | 364/410 |
| 6,029,891 | A | | 2/2000 | Freeman et al. | 235/380 |
| 6,076,731 | A | | 6/2000 | Terrell | 235/454 |
| 6,082,617 | A | | 7/2000 | Meyer-Wittreck et al. | 235/381 |
| 6,084,824 | A | | 7/2000 | Farr | 365/234 |
| 6,089,982 | A | | 7/2000 | Holch et al. | 463/42 |
| 6,098,881 | A | | 8/2000 | DeLand, Jr. et al. | 235/449 |
| 6,116,402 | A | | 9/2000 | Beach et al. | 194/216 |
| 6,280,326 | B1 | | 8/2001 | Saunders | 463/25 |
| 6,280,328 | B1 | | 8/2001 | Holch et al. | 463/42 |
| 6,315,290 | B1 | * | 11/2001 | Roethel et al. | 273/138.1 |
| 6,340,331 | B1 | | 1/2002 | Saunders et al. | 463/25 |

* cited by examiner

GAMING MACHINE WITH HOPPER AND PRINTER

BACKGROUND OF THE INVENTION

1. Field of the Invention

The present invention relates to a gaming machine and more particularly to a gaming machine which enables the operator and/or player to select the form of pay out from the machine before cash out; either by coin or ticket, and allows a ticket to be accepted for wagers.

2. Description of the Prior Art

Various gaming machines are known in which pay outs are made either in coin or by way of a ticket. Examples of gaming machines with coin pay outs are disclosed in commonly owned U.S. Pat. Nos. 4,475,564; 4,518,001; 4,574,824; 4,978,322; and 6,003,651. Such coin operated machines normally include a coin hopper in which coins are collected and transferred to a transport system. Transport systems are known which include a rotating pinwheel for segregating individual coins and transporting the coins to a coin dispenser for pay out. Coin dispensing is under the control of a microprocessor. When a payout is indicated, a counter is used for counting the coins to be dispensed.

There are several problems with such coin operated machines. For example, various mechanical problems are known with such machines. One of these problems relates to coins jamming in the machine. In order to resolve this problem, various mechanical solutions have been developed, for example, as disclosed in commonly owned U.S. Pat. Nos. 4,518,001 and 4,574,824. Another known problem with such coin operated gaming machines is the ability to accurately detect the correct number of coins dispensed for a pay out. Various mechanical and electronic systems have been developed for resolving this problem. For example, U.S. Pat. No. 4,475,564 relates to an improved mechanical design which improves the accuracy of the coin pay outs. In addition, commonly owned U.S. Pat. No. 6,003,651 relates to an electronic sensing system for sensing when the correct number of coins have been paid out.

In addition to those problems, coin operated machines require significant amount of maintenance due to the relatively complicated mechanical mechanism used to accept and pay out coins. As such, there is a trend toward cashless gaming machines, for example, as disclosed in commonly owned U.S. Pat. Nos. 5,265,874 and 5,326,104. In such cashless gaming machines, tickets rather than coins may be used for both playing the game as well as pay outs. Unfortunately, the transition from coin operated machines to cashless gaming machines is difficult for many players used to the older coin operated machines. Thus, there is a need for a gaming machine which helps players transition from the older coin operated machines to the newer cashless gaming machines.

SUMMARY OF THE INVENTION

In one aspect, the invention is directed to a gaming apparatus, comprising: a video display that is capable of generating video images; a value input device; a hopper; and a cashless payout apparatus. The gaming apparatus is programmed to determine a player cash out amount and to determine if the cashless payout apparatus is available for the player cash out amount. The gaming apparatus is also programmed to compare the player cash out amount to a coin pay limit and to determine if a split pay option is available if the player cash out amount is greater than the coin pay limit. Additionally, the gaming apparatus is programmed to pay to a player a first amount equal to the coin pay limit from the hopper and to pay to the player d second amount equal to the player cash out amount minus the coin pay limit utilizing the cashless payout apparatus, if the split pay option is available.

In another aspect, the invention is directed to a gaming apparatus, comprising: a video display that is capable of generating video images; a value input device; a hopper; and a cashless payout apparatus. The gaming apparatus is programmed to determine a player cash out amount and to determine if a split pay option is available. The gaming apparatus is also programmed to receive a distribution input from a player corresponding to the player cash out amount if the split pay option is available, wherein the distribution input is a portion of the player cash out amount that the player wants to receive from the hopper. Additionally, the gaming apparatus is programmed to pay to the player a first amount equal to the distribution amount from the hopper and to pay to the player a second amount equal to the player cash out amount minus the distribution amount utilizing the cashless payout apparatus, if the split pay option is available.

DESCRIPTION OF THE DRAWINGS

These and other advantageous of the present invention will be readily understood with reference to the following specification and attached drawings wherein.

DETAILED DESCRIPTION

FIGS. 1–9 relate to a gaming machine which enables an operator and/or player to select the form of the pay; either by coins, or by a ticket, or by a combination of both. In this way, the player will be given the look and feel of a coin operated machine but also have the option for different forms of pay out to simplify the transition from coin operated machines to cashless gaming machines. As such, the gaming system in accordance with the present invention aids the transition for players from coin operated gaming machines to cashless gaming machines, and accommodates various players' preferences.

Figure 1:
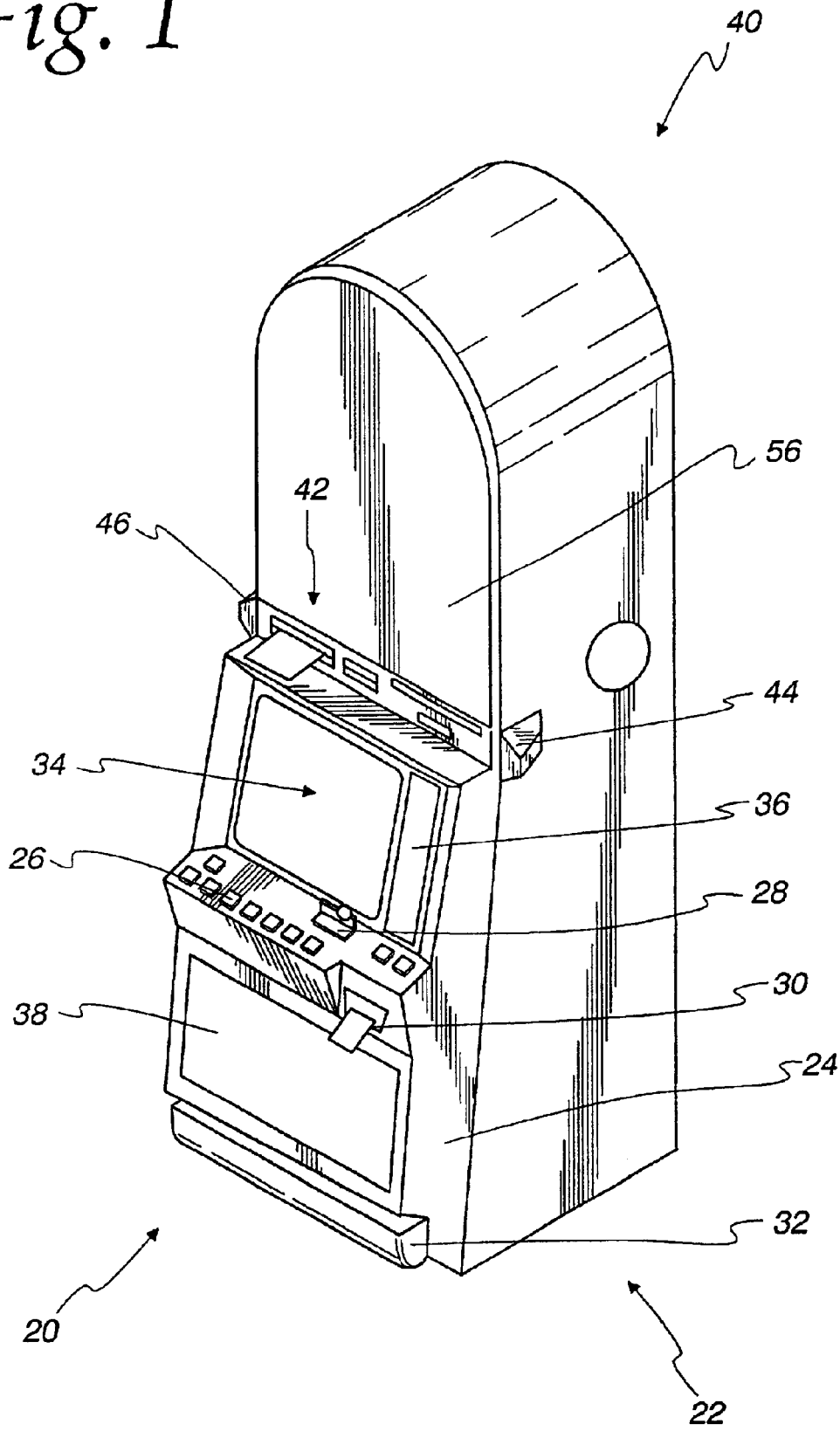
FIG. 1 is a perspective view of a gaming machine in accordance with the present invention.

Referring to FIG. 1 an exemplary gaming machine is shown. The gaming machine, generally identified with the reference numeral 20, includes a housing, generally identified with the reference numeral 22. In order to provide access to the interior of the machine 20, the front portion 24 of the housing 22 may be configured to provide access to the interior of the gaming machine 20 for on-site maintenance and repair as well as for upgrades. In the exemplary gaming machine 20 illustrated in FIG. 1, various player input/output (I/O) devices are provided on the front portion 24 of the housing. For example, a plurality of player input switches 26 are provided, that enable a player to select, for example, the form of the desired pay out, either coins or ticket. Alternatively, the player selections may be made by way of a touch screen as described below. The front housing portion 24 also includes a coin acceptor 28, a bill validator/ticket reader 30 and a coin tray 32.

A video display 34 is also carried by the gaming machine 20. The video display 34 may be a cathode ray tube display, high resolution flat panel liquid crystal display (LCD) or other conventional electronically controlled video display. An information panel 36 may be disposed adjacent the video display 34. The information panel 36 may be formed from a backlit silk screened glass panel with lettering to indicate general game information including, for example, the amount of wager. The bottom of the housing 22 may be closed by what is known as a belly glass 38.

A ticket printer 42 and a pair of speakers 44 and 46 are carried by an upper portion 40 of the housing 22. The bill validator/ticket reader 30, used to validate currency and read and/or validate machine readable tickets, along with the ticket printer 42 allow for cashless: operation for a gaming machine. The coin acceptor 29 along with the coin tray 32 enable coin operated play of the gaming machine 20.

Figure 2:
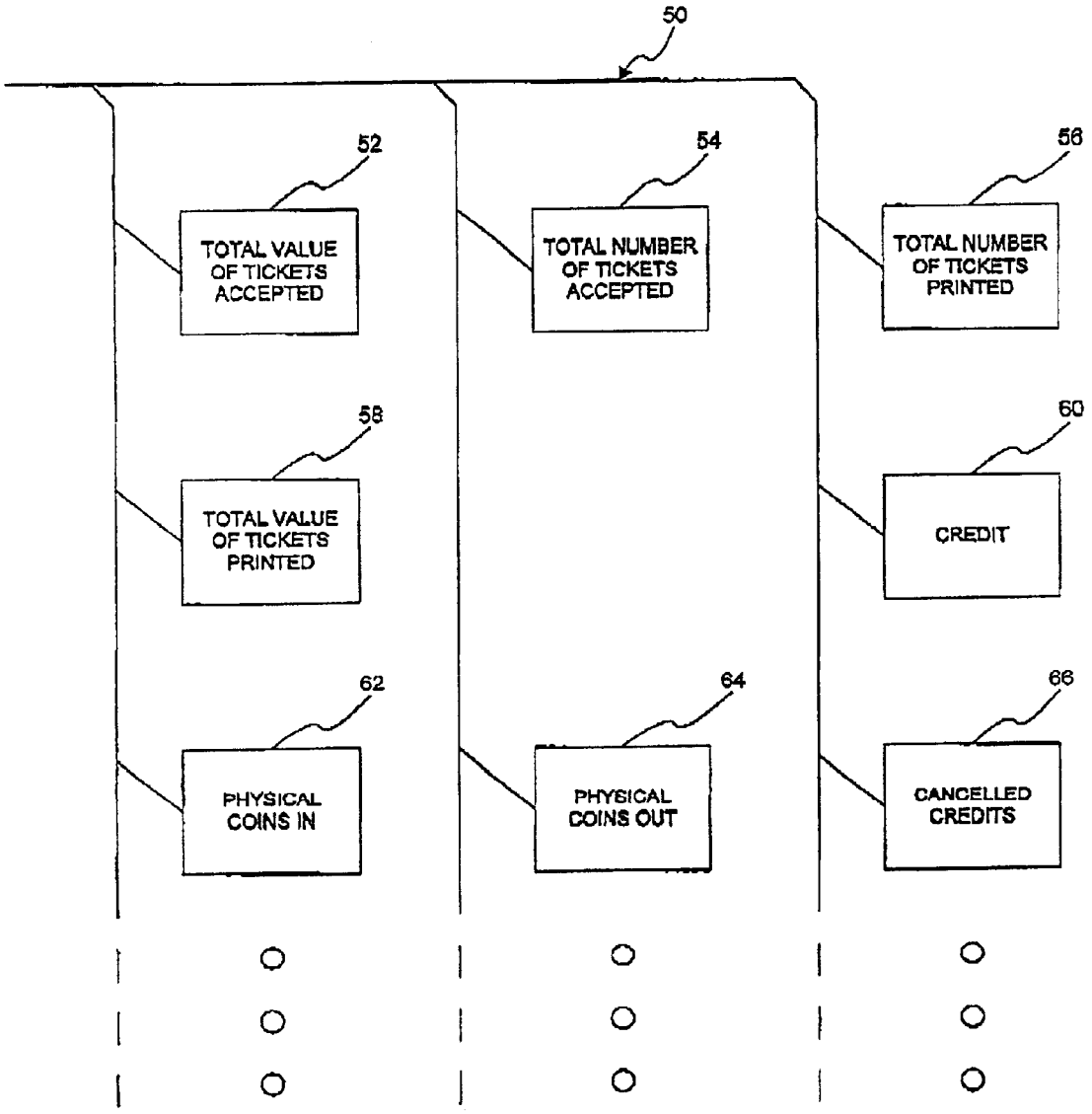
FIG. 2 is a block diagram of the electronic meters for the gaming machine illustrated in FIG. 1.

As is known in the art, an electronic storage meter set, such as the exemplary meter set 50, illustrated in FIG. 2, is required by gaming authorities. The meter set 50 includes a plurality of electronic meters which allows verification of the coins and tickets that are input to the machine as well as the coins and tickets that are paid out of the machine. In order to comply with regulatory requirements, the meter set 50 in accordance with the present invention includes the electronic meters normally provided on a coin operated gaming machine as well as electronic meters found on cashless gaming machines. The meter set 50 includes electronic meters 52, 54, 56, 58, 60, 62, 64, and 66 for the following types of data; TOTAL VALUE OF TICKETS ACCEPTED; TOTAL NUMBER OF TICKETS ACCEPTED; TOTAL NUMBER OF TICKETS PRINTED; TOTAL VALUE OF TICKETS PRINTED; CREDIT; PHYSICAL COINS IN; PHYSICAL COINS OUT; and CANCELED CREDITS, respectively.

Figure 3:
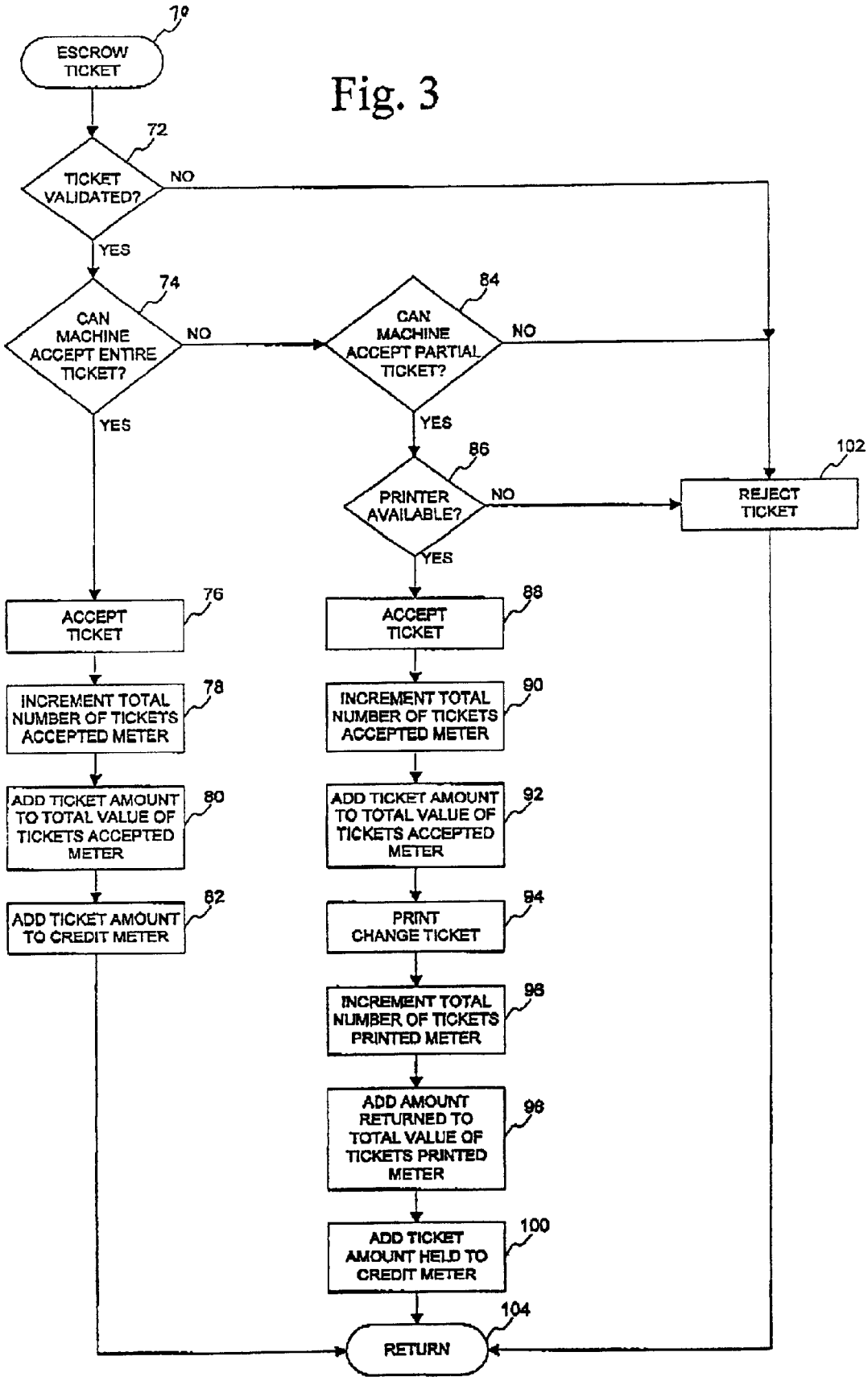
FIG. 3 is a flow diagram of a system for accepting tickets for playing the game which forms part of the present invention.
Figure 4:
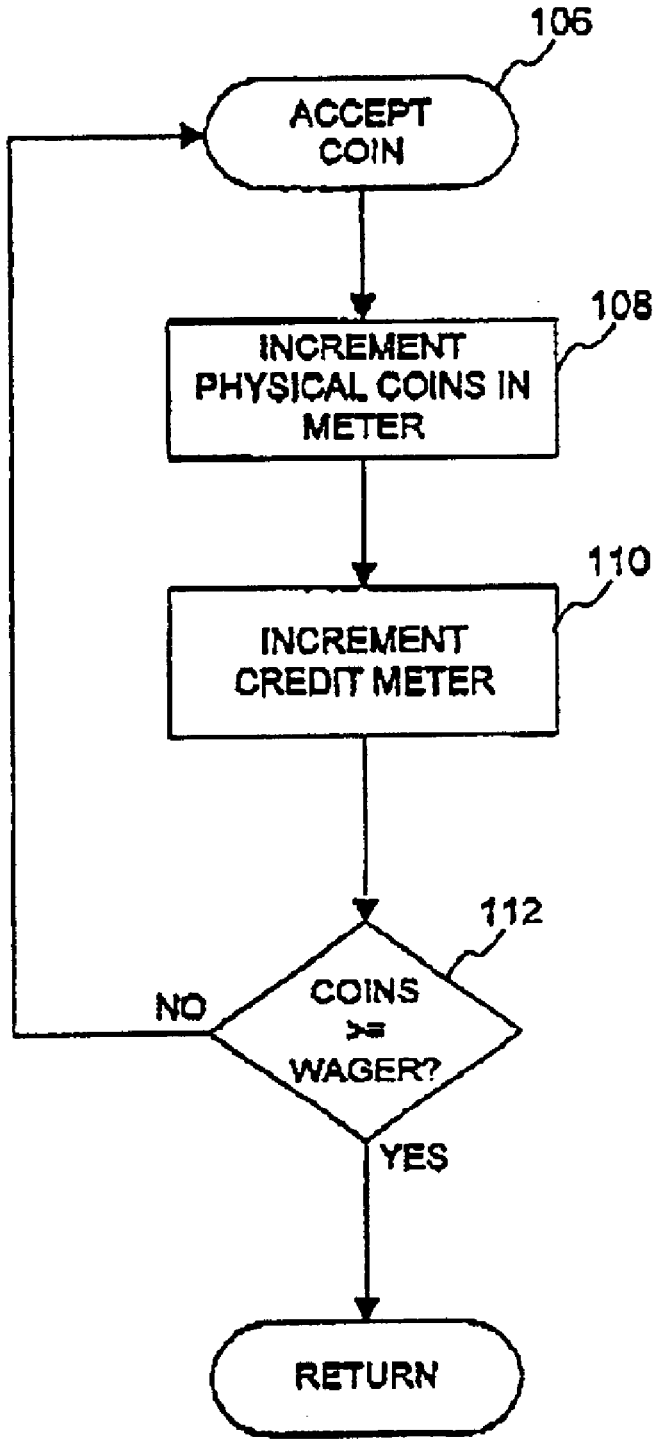
FIG. 4 is a flow diagram of a system for accepting coins for playing the game machine illustrated in FIG. 1.

The gaming machine in accordance with the present invention is formed to have all of the standard hardware as in a coin operated gaming machine, for example, as disclosed in U.S. Pat. Nos. 4,475,564; 4,518,001; 4,574,824; 4,978,322; 5,167,571 and 6,003,651; as well as the hardware for cashless gaming machines, for example, as disclosed in U.S. Pat. Nos. 5,265,874 and 5,326,104, hereby incorporated by reference. FIGS. 3 and 4 illustrate the software for wager acceptance system, for cashless operated play and coin-operated play, respectively. FIGS. 5–9 illustrate the software for the pay out system in accordance with the present invention.

The wager acceptance system, as used herein, may include one or more of the systems described below. For example, the wager acceptance system may include a conventional coin acceptor for accepting coin wagers and/or a conventional bill validator/ticket reader that can receive and validate currency as well as read and/or validate machine readable tickets, for example, encoded with a bar code, magnetic code, optical code, or electronic code all of which are known in the art. For example, commonly owned U.S. Pat. No. 5,676,231 discloses a system for validating currency. U.S. Pat. No. 5,949,042 discloses a system for reading machine readable information, such as bar codes.

Systems for reading magnetic information encoded on different media are also known. For example, U.S. Pat. Nos. 6,098,881; 6,082,617 and 6,076,731, incorporated by reference, disclose systems for reading so called magnetic stripes encoded on the back of various media, such as plastic substrates, similar to credit cards. Yet other systems are known, for reading, for example, magnetic tokens, for example, as disclosed in U.S. Pat. No. 6,029,891.

Optical a readers are also known. An exemplary optical reader is disclosed in U.S. Pat. No. 6,084,824, hereby incorporated by reference.

The wager acceptance system may also include a so called smart card reader. An example of a smart card reader is disclosed in U.S. Pat. No. 5,624,316, hereby incorporated by reference.

An exemplary wager acceptance system with a validator/ticket reader and coin acceptor is described below. Other types of wage acceptance systems are understood to operate in a similar manner. Referring to FIG. 3, the exemplary wage acceptance system monitors the bill validator/ticket reader 30 and the coin acceptor 28 and establishes a credit for playing the game when coins, bills or tickets are detected.

In particular, the system monitors the ticket reader 30 (FIG. 1) awaiting a ticket to be inserted into the gaming machine 20. When the system senses a ticket has been escrowed by the ticket reader 30 in step 70, it determines if the ticket is valid in step 72. If the ticket is valid, the system determines whether the entire ticket amount can be accepted in step 74. If the entire ticket amount can be accepted, the ticket is retained by the ticket reader 30 in step 76. Subsequently, in step 78 the TOTAL NUMBER OF TICKETS ACCEPTED meter 54 (FIG. 2) is incremented, in step 80 the total ticket value is added to the TOTAL VALUE OF TICKETS ACCEPTED meter 52, and in step 82 the total ticket value is added to the CREDIT meter 60. The CREDIT meter 60 maintains the credit amount available to play the game.

If the system determines in step 74 that it cannot accept the entire ticket amount, for example, if the amount is not evenly divisible by the machine denomination or would cause the credit limit to be exceeded, the system determines in step 84 if it can accept a portion of the ticket amount and if so, in step 86, the system determines whether a printer is available. If the ticket is not valid, no portion of the ticket can be accepted, or no printer is available to print a change ticket, the ticket is rejected in step 102 and the system returns in step 104.

If the system determines that it can accept a portion of the ticket and a printer is available, the ticket is retained by the ticket reader 30 in step 88. Subsequently, in step 90 the TOTAL NUMBER OF TICKETS ACCEPTED meter 54 is incremented, and in step 92 the total ticket value is added to the TOTAL VALUE OF TICKETS ACCEPTED meter 52. In step 94 a change ticket is printed for the amount to be returned to the player, in step 96 the TOTAL NUMBER OF TICKETS PRINTED meter 56 is incremented, and in step 98 the amount of the change ticket amount is added to the TOTAL VALUE OF TICKETS PRINTED meter 58. In step 100 the amount of the ticket value that was not returned to the player is added to the CREDIT meter 60.

The software for a coin wager acceptance system is illustrated in FIG. 4. Initially, the system monitors the coin acceptor 28 (FIG. 1) to determine if coins have been deposited therein in step 106. If so, the system increments the PHYSICAL COINS IN meter 62 (FIG. 2) and the CREDIT meter 60 in steps 108 and 110. The system then determines in step 112 whether the coins inserted are equal to or greater than the minimum wager for the game 20. If not, the system continues to monitor the coin acceptor 28, otherwise it enables the game.

Figure 5:
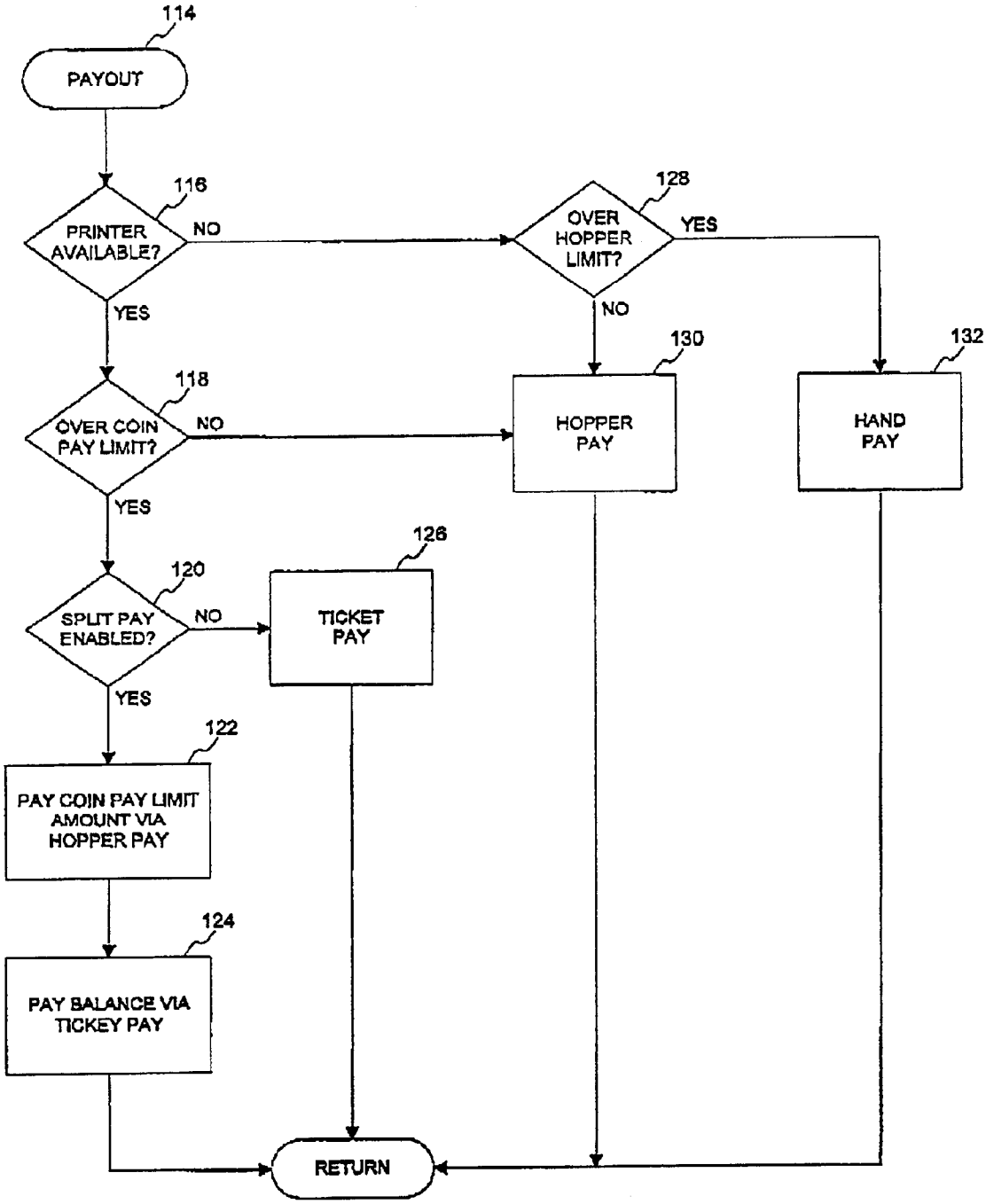
FIG. 5 is a flow diagram of a pay out system which forms part of the present invention.
Figure 6:
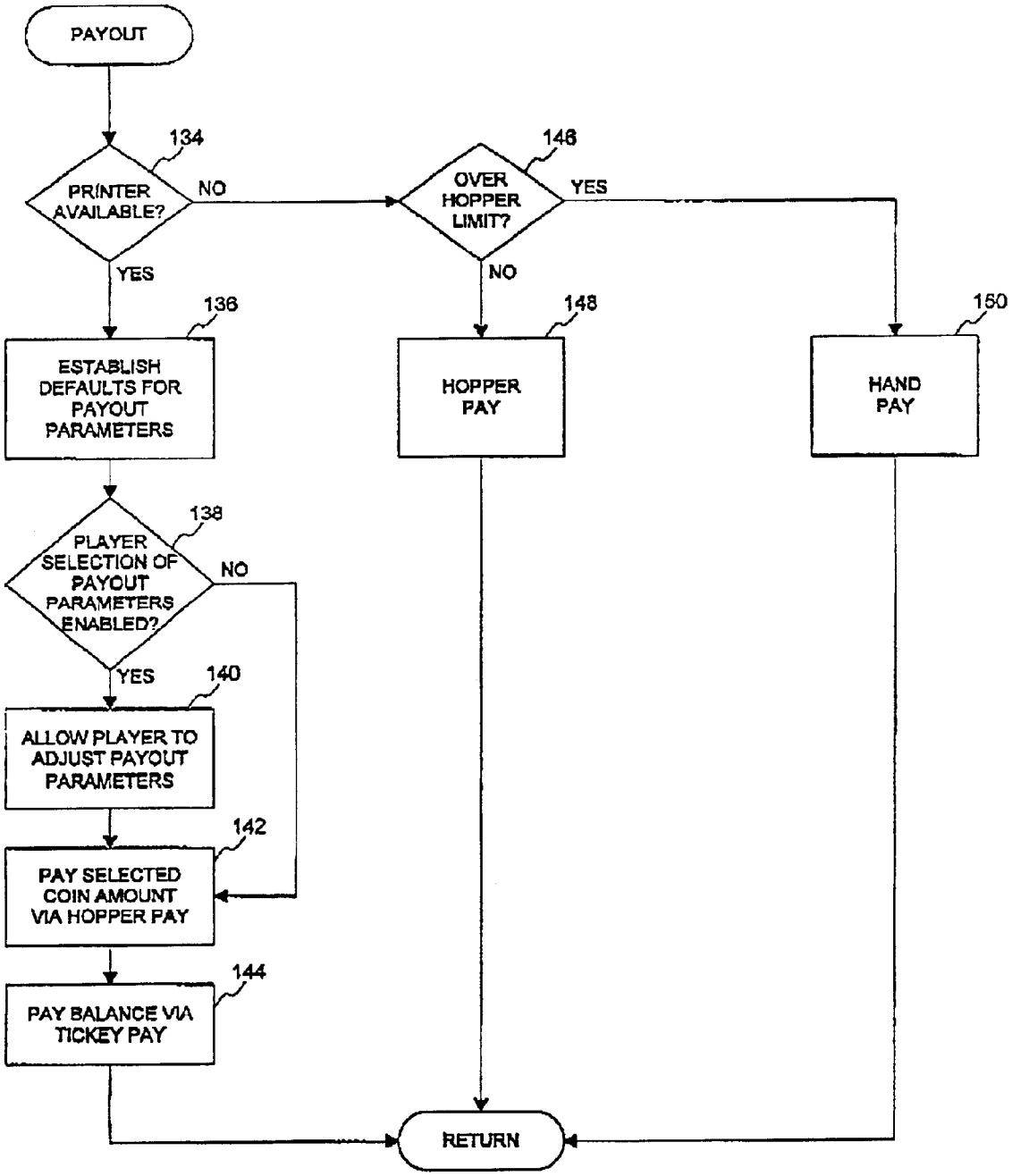
FIG. 6 is a flow diagram of a pay out system which forms part of the present invention.
Figure 7:
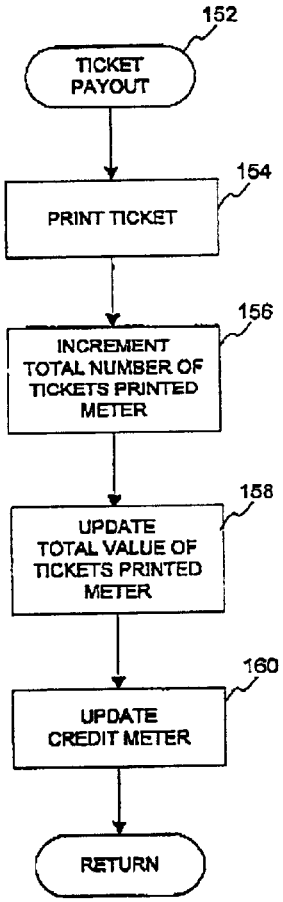
FIG. 7 is a flow diagram of a ticket pay out system in accordance with the present invention.
Figure 8:
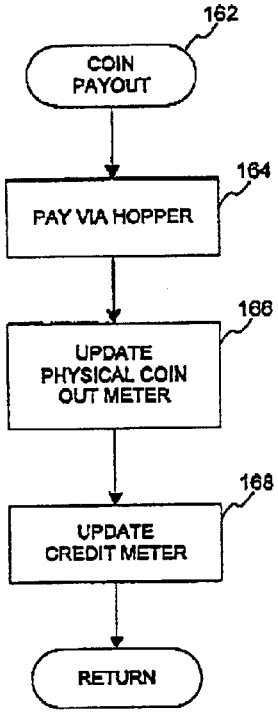
FIG. 8 is a flow diagram of a coin pay out system in accordance with the present invention.
Figure 9:
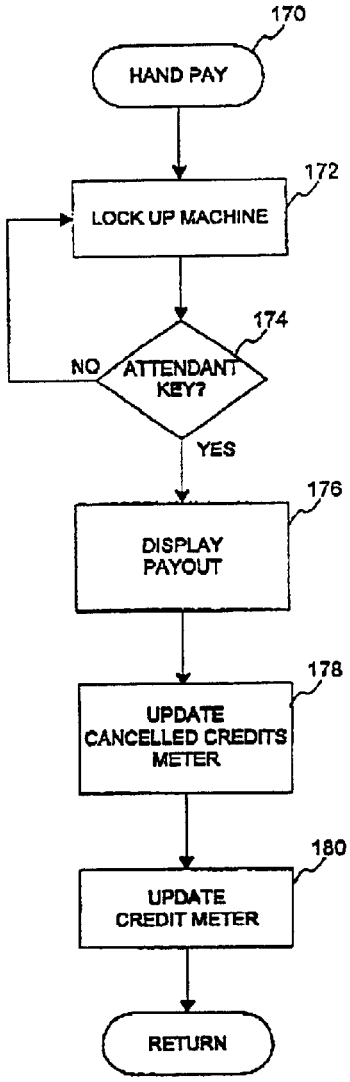
FIG. 9 is a flow diagram of a hand pay out system in accordance with the present invention.

As discussed below, the gaming machine 20 includes a pay out system for enabling the operator and/or player to select the type of pay out to be either a cashless pay out in the form of a ticket, or a coin pay out, or a combination of both. During certain conditions as discussed below, the player may also be paid manually by the attendant. The software for pay outs is illustrated in FIGS. 5–9. In particular, FIG. 5 represents the main system for operator selection of pay outs. FIG. 6 represents the main system for player selection of pay outs. FIG. 7 is a subroutine for ticket pay outs. FIG. 8 is a subroutine for coin pay outs while FIG. 9 is a subroutine for manual pay outs.

In accordance with an important aspect of the invention, the gaming machine 20 includes a pay out system which enables a player to select by way of the player input switches 26(FIG. 1), for example, from multiple forms of pay out, for example, by way of coins or by way of a cashless payout, for example a ticket, a magnetic card or by way of a smart card. Systems for enabling coin pay outs are disclosed in commonly owned U.S. Pat. Nos. 4,475,564 and 6,003,651, hereby incorporated by reference.

Cashless payouts by way of a ticket may include a printer for printing pay out information such as a pay out amount and/or in machine readable form, such as a bar code. An example of a system for printing tickets is disclosed in U.S. Pat. No. 5,595,538, hereby incorporated by reference.

Other cashless payout systems include a programmer for programming magnetic media such as magnetic stripes or a smart card. Magnetic smart card programmers are known in the art. An example, of a magnetic programmer is disclosed in U.S. Pat. No. 4,650,978, while an example of a smart card programmer is disclosed in U.S. Pat. No. 5,624,316, both hereby incorporated by reference.

In situations where the payout is over the coin pay limit of the machine, the machine 20 may provide for a split option, which allows the pay out to be split between coins and a ticket. In one embodiment, this option may be configured by an operator during set up of the machine, for example, by way of a touch screen, for example as disclosed in commonly owned U.S. Pat. No. 6,007,426, hereby incorporated by reference. Alternatively, the option may be selected by the player, for example, by the player input switches 26 or by touch screen as discussed above.

In other embodiments, the gaming machine may be configured at least in part remotely, for example, in response to a remote signal, for example, from a remote data base, which may be used to configure a machine in response to certain data, for example, as disclosed in U.S. Pat. No. 5,470,079, hereby incorporated by reference.

Turning first to FIG. 5, the system monitors the status of the player input switches 26 on the front portion 24 of the housing 22 or touch screen interface to detect a player request for pay out in step 114. If the system determines that a printer is available for player cash outs step 116, the cash out amount is compared to an operator selected coin pay limit in step 118. If the cash out amount is greater than the coin pay limit, the system checks to see if the split pay option has been enabled in step 120. If split pay is enabled, an amount equal to the coin pay limit is paid from the hopper in step 122, by way of the system steps illustrated in FIG. 8, and the balance is paid by ticket in step 124, byway of the system steps illustrated in FIG. 7. If split pay was not enabled in step 120, the entire cash out is paid by ticket in step 126. If the cash out amount was not over the coin pay limit in step 118, the entire cash out is paid by the hopper in step 130. However, if the printer is not available for player cash out in step 116, for example, due to a printer malfunction, or inability to validate a ticket, the cash out amount is compared to the hopper limit in step 128. If the cash out is greater than the hopper limit, it results in a hand pay in step 132 by way of the system steps illustrated in FIG. 9, otherwise it is paid by the hopper in step 130.

FIG. 6 is a system to for handling the same cash out, where the configuration of the payout parameters may be provided by operator configuration of the gaming machine 20 as discussed above, or by a central data base, and subsequently optionally adjusted by the player. If the system determines that a printer is available for player cash outs in step 134, the system determines default pay out amounts for the printer and hopper in step 136 based on operator configuration as described in FIG. 5, or information derived from another source, such as a central data base, or information stored on a magnetic stripe card or smart card. In step 138, the system determines whether the player is to be allowed to select how much of the cash out is to come from the hopper and how much is to come from the printer. If player selection of cash out parameters is enabled, system flow proceeds to step 140. The player is provided with two pay out options; coin and ticket. Initially, the system monitors the state of the player input switches 26 of the front portion 24 of the housing 22 to determine which pay out option has been selected; either coin or ticket. In order to account for various situations, the system may enable a split pay option to allow for pay outs in both coin and ticket. Depending on the player selection, the system will pay out according to the player's selection to the extent possible considering the status of the machine and the amount of the pay out, paying out the selected coin amount in step 142 and the selected ticket amount in step 144. Should the system determine in step 134 that the printer is not available, the system next checks in step 146 whether the pay out amount exceeds the hopper limit. If it does not, the system initiates a coin pay out in step 148. Otherwise, an attendant or hand pay is initiated in step 150. With this option, a gaming machine attendant is signaled to make a manual pay out to the player.

FIGS. 7–9 describe the system steps to accomplish each of the individual pay out procedures for ticket, coin, or hand pays. Referring first to FIG. 7, if a ticket pay out has been initiated, as discussed above and determined in step 152, the system prints the ticket for the pay out amount in step 154. The system also increments the TOTAL NUMBER OF TICKETS PRINTED meter 56 (FIG. 2) and updates the TOTAL VALUE OF TICKETS PRINTED meter 58 in steps 156 and 158, respectively. The CREDIT meter 60 is updated in step 160, by subtracting the value of the printed ticket from the CREDIT meter 60.

FIG. 8 illustrates the software for a coin pay out. Initially, if a coin pay out is initiated as discussed above in step 162, coins are paid out by way of a hopper in step 164. The 1PHYSICAL COINS OUT meter 64 (FIG. 2) is updated in step 166 and the CREDIT meter 60 is updated in step 168 by subtracting the number of coins paid out by way of the hopper.

As mentioned above, there are several circumstances in which neither the ticket pay out or the coin pay out are possible. In these situations, as discussed above, a hand or attendant pay out is initiated. Whenever a hand pay out is initiated, as in step 170, the system locks up the machine in step 172. The machine remains in a locked out condition until a gaming machine attendant actuates a key operated switch which is monitored in step 174. After the key operated switch is actuated, the pay out amount is displayed in step 176, the hand pay amount is added to the TOTAL CANCELED CREDIT meter in step 178, and the CREDIT meter 60 is updated in step 180.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters patent of the United States is:

We claim:

1. A gaming apparatus, comprising:

a video display;

a value input device;

a hopper, and a cashless payout apparatus;

said gaming apparatus being programmed to determine a player cash out amount, said gaming apparatus being programmed to determine if a split pay option is available, said gaming apparatus being programmed to receive a distribution input from a player corresponding to said player cash out amount if said split pay option is available, said distribution input being a portion of said player cash out amount that sad player wants to receive from said hopper, and said gaming apparatus being programmed to pay to said player a first amount equal to said distribution amount from said hopper and to pay to said player a second amount equal to said player cash out amount minus said distribution amount utilizing said cashless payout apparatus, if said split pay option is available.

2. A gaming apparatus as defined in claim 1 wherein said gaming apparatus is programmed to determine a first default payout amount for said hopper and a second default payout amount for said cashless payout apparatus.

3. A gaming apparatus as defined in claim 2, wherein said gaming apparatus is programmed to allow said player to adjust said first default payout amount and said second default payout amount.

4. A gaming apparatus as defined in claim 1, wherein said gaming apparatus is programmed to compare said player cash out amount to a coin pay limit.

5. A gaming apparatus as defined in claim 4 wherein said gaming apparatus is programmed to pay to said player said cash out amount from said hopper if said player cash out amount is less than or equal to said coin pay limit.

6. A gaming apparatus as defined in claim 1, wherein said gaming apparatus is programmed to pay to said player said cash out amount from said hopper if said cashless payout apparatus is not available.

7. A gaming apparatus, comprising:

a video display;

a value input device;

a hopper; and a cashless payout apparatus;

said gaming apparatus being programmed to determine a player cash out amount, said gaming apparatus being programmed to determine a first default payout amount for said hopper and a second default payout amount for said cashless payout apparatus, said gaming apparatus being programmed to determine if a player is allowed to modify said first and said second payout amounts, said gaming apparatus being programmed to receive an input from said player, said input corresponding to a first modified payout amount to be paid to said player from said hopper and a second modified payout amount to be paid to said player from said cashless payout apparatus, wherein the sum of said first modified payout amount and said second payout amount equals said cash out amount, and said gaming apparatus being programmed to pay to said player said first modified payout amount from said hopper and to pay said second modified payout amount utilizing said cashless payout apparatus.

8. A gaming apparatus as defined in claim 7 wherein said gaming apparatus is programmed to determine if said first modified payout amount exceeds a hopper limit.

9. A gaming apparatus as defined in claim 8 wherein said gaming apparatus is programmed to pay to said player said first modified payout amount from said hopper if said first modified payout amount is less than or equal to said hopper limit.

10. A gaming apparatus as defined in claim 7, wherein said gaming apparatus is programmed to pay to said player said cash out amount from said hopper if said cashless payout apparatus is not available.

11. A gaming apparatus, comprising:

a value input device;

a mechanically rotatable wheel;

a hopper, and a cashless payout apparatus;

said gaming apparatus being programmed to determine a player cash out amount, said gaming apparatus being programmed to determine if a split pay option is available, said gaming apparatus being programmed to receive a distribution input from a player corresponding to said player cash out amount if said split pay option is available, said distribution input being a portion of said player cash out amount that said player wants to receive from said hopper, and said gaming apparatus being programmed to pay to said player a first amount equal to said distribution amount from said hopper and to pay a second amount equal to said player cash out amount minus said distribution amount utilizing said cashless payout apparatus, if said split pay option is available.

* * * * *